United States Patent [19]

Favrel

[11] 4,091,570

[45] May 30, 1978

[54] OBLIQUE-DISPLACEMENT SLIDING DOOR

[75] Inventor: Michel Favrel, Le Perreux-sur-Marne, France

[73] Assignee: Faiveley S.A., Saint-Ouen, France

[21] Appl. No.: 631,924

[22] Filed: Nov. 14, 1975

[30] Foreign Application Priority Data

Dec. 10, 1974 France ..... 74 40483

[51] Int. Cl.[2] ..... E05F 17/00

[52] U.S. Cl. ..... 49/118; 49/215; 49/218; 49/362

[58] Field of Search ..... 49/116, 118, 128, 129, 49/130, 149, 153, 154, 155, 208–210, 213–216, 218–221, 223, 225, 360, 362; 160/118, 206

[56] References Cited

U.S. PATENT DOCUMENTS

| | | | |
|---|---|---|---|
| 1,051,054 | 1/1913 | Anderson | 160/260 |
| 2,552,356 | 5/1951 | Weigele | 49/210 |
| 3,261,128 | 7/1966 | Slopa et al. | 49/221 |
| 3,453,778 | 7/1969 | Daugirdas | 49/215 |
| 3,844,062 | 10/1974 | Daugirdas | 49/118 |
| 3,906,668 | 9/1975 | Simmons | 49/360 |

FOREIGN PATENT DOCUMENTS

| | | |
|---|---|---|
| 258,136 | 11/1967 | Austria. |
| 511,580 | 11/1930 | Germany. |
| 623,699 | 1/1936 | Germany. |
| 1,930,485 | 9/1969 | Germany. |
| 617,512 | 5/1946 | United Kingdom. |

*Primary Examiner*—Peter M. Caun
*Attorney, Agent, or Firm*—Young & Thompson

[57] ABSTRACT

The door comprises at least one sliding leaf which is capable of engagement and disengagement transversely within a stationary door-frame, a leaf-stabilizing system consisting of at least one slide-bar mounted opposite to the top leaf-edge alone, operating means for displacing the leaf in the direction of sliding motion, a deformable coupling system provided with means for suspending the leaf from the associated slide-bar so that the leaf can be displaced in translational motion by the operating means and transversely under the action of at least one guide rail which is rigidly fixed to the door-frame.

4 Claims, 10 Drawing Figures

1
2a
2b
3
6a
6b
11a
11b
12a
12b
16a
16b
16c
16d
21a
21b
21c
21d
23a
23b
24a
24b
25a
25b
31a
31b
32
33
34
35
36
37
38
39
41
43
V

OBLIQUE-DISPLACEMENT SLIDING DOOR

This invention relates to an oblique-displacement sliding door comprising a stationary frame and at least one leaf which may be flat, for example, and is capable of moving along an axis of sliding motion, said sliding door-leaf being associated with guiding means connected to the door-frame for engaging the leaf transversely within the frame in the position of closure and for disengaging said leaf in the opposite direction.

In the door-operating mechanism of the type referred-to, provision must be made in addition for a leaf-stabilizing system which serves to maintain at least one axis of the door-leaf plane at right angles to the axis of sliding motion during the movements of the leaf in order to prevent any effect of jamming of this latter against its guiding means which consist in most cases of shaped-section rails.

One leaf-stabilizing system of known type consists of two toothed racks mounted on the door-leaf in a direction parallel to the direction of sliding motion and each associated with a pinion supported by a carriage, said carriage being retained by a guide which is parallel to the toothed racks. The two pinions are driven together in rotation by a shaft which is placed transversely with respect to the toothed racks and coupled to the door-frame by means of two articulated crank-arms pivotally mounted on the shaft. These two articulated crank-arms and the coordinating shaft can be associated with the door-operating mechanism in a number of different ways.

Systems of the type mentioned in the foregoing have been disclosed in particular in French Pat. No. 2,133,309 and in French Pat. application No. 73 432 223 of Dec. 4th, 1973, both in the name of the present Applicant. These systems provide satisfactory operation under conditions of service. However, the construction of the door-leaf is complicated by the presence of the toothed racks and the guides which are carried by the leaf. Furthermore, the doorway clearance provided in the open position of the leaf is appreciably reduced by the presence of the shaft for the coordination of the pinions associated with the toothed racks. This limitation is particularly objectionable in some instances and especially in the case of doors for public transportation vehicles to which the invention is primarily directed.

The aim of the invention is to overcome the disadvantages mentioned above by making it possible to construct an oblique-displacement sliding door in which the leaf-stabilizing system is simple and of small overall size, especially by virtue of the fact that the toothed racks and associated pinions as well as their coordinating shaft have been dispensed with in order to facilitate the construction of the door-leaf and to provide the full design clearance within the door-frame in the open position of the door.

The invention is concerned with an oblique-displacement sliding door comprising a stationary door-frame, at least one door-leaf which is vertical in the service position and capable of moving along a substantially horizontal axis parallel to a top edge and a bottom edge of the door-leaf; said leaf is associated with guide means in order to be engaged transversely within the door-frame in the closed position and disengaged from the frame in the opposite direction; operating means are provided for producing action on the door-leaf in the direction of sliding motion and means are also provided for stabilizing each leaf; said leaf-stabilizing means comprise at least one slide-bar which is slidably mounted parallel to the axis of sliding motion of the leaf and is connected to this latter by means of a deformable coupling system.

In accordance with the invention, the door aforesaid is distinguished by the fact that the slide-bar is mounted opposite to the top edge alone of the door-leaf and in proximity to at least one guide rail which is rigidly fixed to the door-frame and associated with the top edge aforesaid; the carriage is connected to the operating means and the deformable coupling system comprises means for suspending the door-leaf from the associated carriage in order to permit translational displacement of the leaf by the operating means in the direction of sliding motion and transverse displacement of said leaf under the action of each guide rail.

The deformable coupling system permits the transverse engagement of the door-leaf within the frame in the position of closure and the disengagement of the leaf in the opposite direction under the action of the guide means. The coupling system aforesaid serves to displace the door-leaf in translational motion along the axis of sliding motion under the action of the operating means. Suspension of the door-leaf solely by means of its top edge facilitates guiding of the leaf while at the same time preventing jamming which could result from any deformation of the door-frame. In the open position of the door-leaf, the passageway provided by the door-frame can be left entirely free and unobstructed since no mechanism is located opposite to a vertical edge of the frame.

Preferably, the suspension means of the deformable coupling system which connects the top edge of the door-leaf to the carriage comprise means whereby the position of the door-leaf with respect to the carriage can be adjusted in the vertical direction.

The assembly and positional adjustment of the door in accordance with the invention is thus facilitated, especially with a view to forestalling any danger of jamming.

In accordance with one advantageous embodiment of the invention, the carriage is constituted by a slide-bar associated with a ball slideway which is parallel to the axis of sliding motion of the door-leaf: for the operation of this latter, the slide-bar is connected to a jack which is rigidly fixed to the door-frame. The deformable coupling system which connect the carriage to the top edge of the leaf comprises two crank-arms set a distance from each other in substantially parallel relation, one extremity of each crank-arm being pivotally mounted on the leaf and the other extremity being pivotally mounted on the carriage along pivotal axes which are parallel to the leaf and perpendicular to the axis of sliding motion; the guide rails which are preferably U-section members each have a rectilineal portion parallel to the axis of sliding motion and an oblique portion, said guide rails being associated with rollers each mounted on a connecting member which is removably fixed on the door-leaf; the connecting member comprises means for suspending the door-leaf from the carriage by means of an articulated crank-arm whose extremity is coupled to said connecting member.

As will be made clear in the description given hereinafter, convenient construction and long service life of the door in accordance with the invention are made possible by means of the arrangements mentioned in the foregoing.

In another embodiment of the invention, the deformable coupling system which connects the slide-bar to the top edge of the door-leaf comprises two substantially vertical suspension arms each having an upper extremity which is rigidly fixed to the carriage and a lower extremity which is slidably mounted on a transverse rod which is attached to the top edge of the door-leaf.

Preferably, in particular for public transportation vehicles to which the invention is especially directed, the oblique-displacement sliding door has two opposite leaves mounted symmetrically on a common axis of sliding motion; the slide-bars associated with each door-leaf are mounted on slideways having the same axis; the movements of the slide-bars are combined symmetrically by means of a coordinating mechanism. This mechanism can advantageously comprise on each slide-bar a nut associated with a threaded rod rotatably mounted on supports connected to the frame in parallel relation to the axis of the slideways; the rod and the nut associated with the slide-bar of each door-leaf constitute a reversible-action motion converter between the jack and the two associated door-leaves.

It is thus possible to construct a door which has very smooth and silent operation as explained in the following description.

Further properties and advantages of the invention will become apparent from the following description of two embodiments of the invention which are presented hereinafter by way of non-limitative example, reference being made to the accompanying drawings, wherein.

Figures 1, 2:
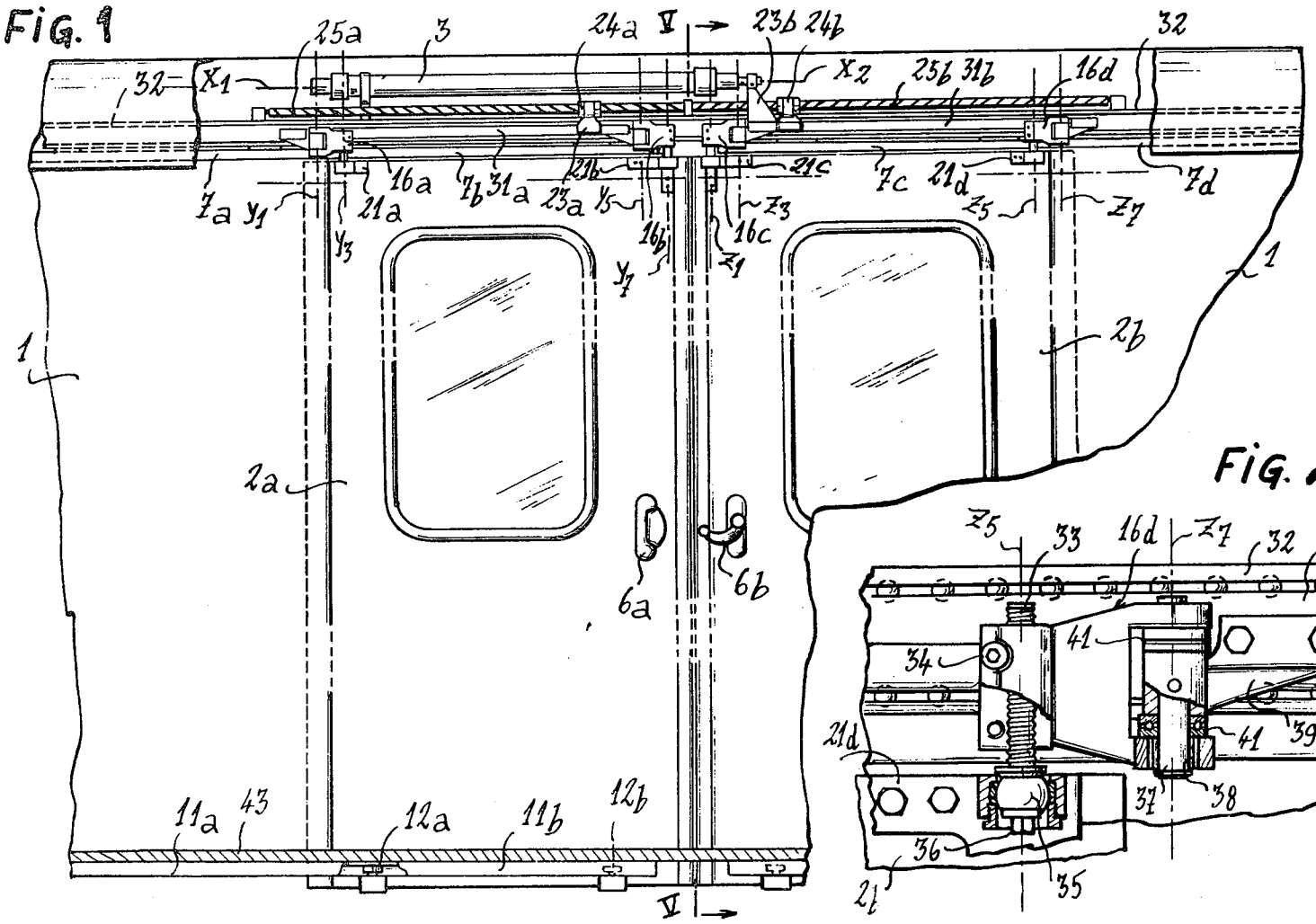
FIG. 1 is a view in front elevation in the direction of the arrow III of FIG. 5 and showing a first industrial form of construction of the door.
FIG. 2 is a fragmentary detail view showing the assembly of a connecting crank-arm of one leaf of the door of FIG. 1.
Figure 3:
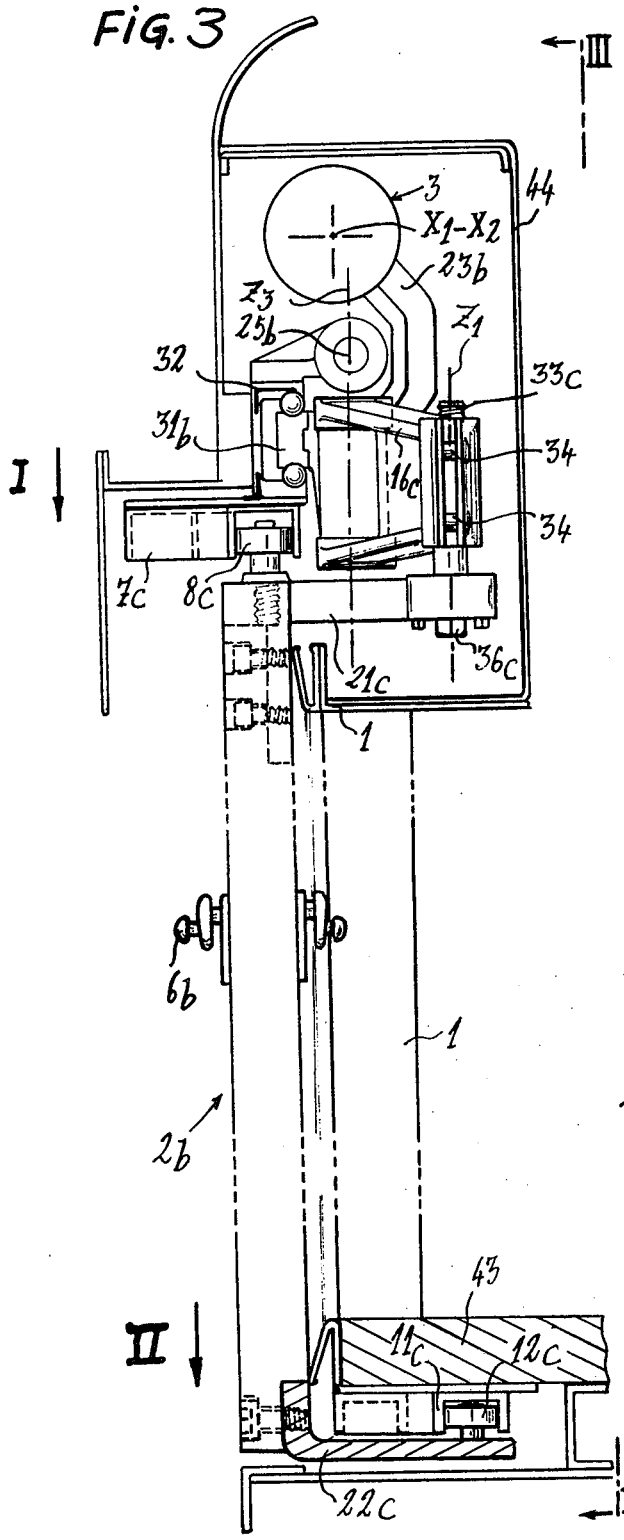
FIG. 3 is a view in elevation in the closed position of the door of FIG. 1, this view being taken in cross-section along line V—V of FIG. 1.
Figure 4:
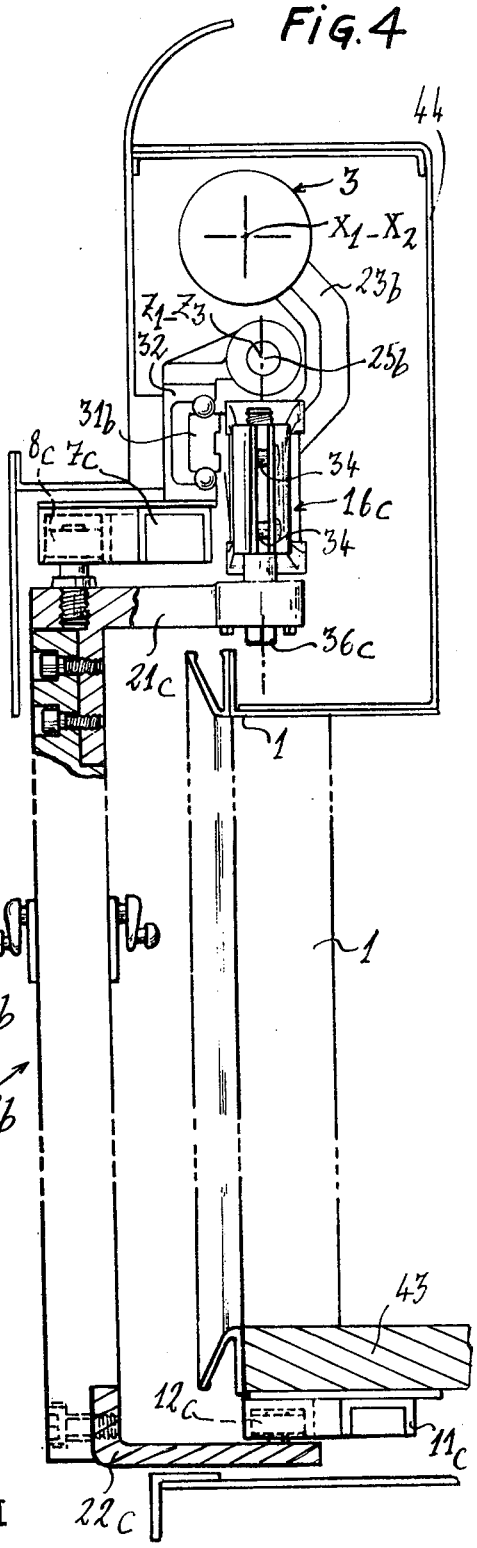
Figures 5, 6, 7:
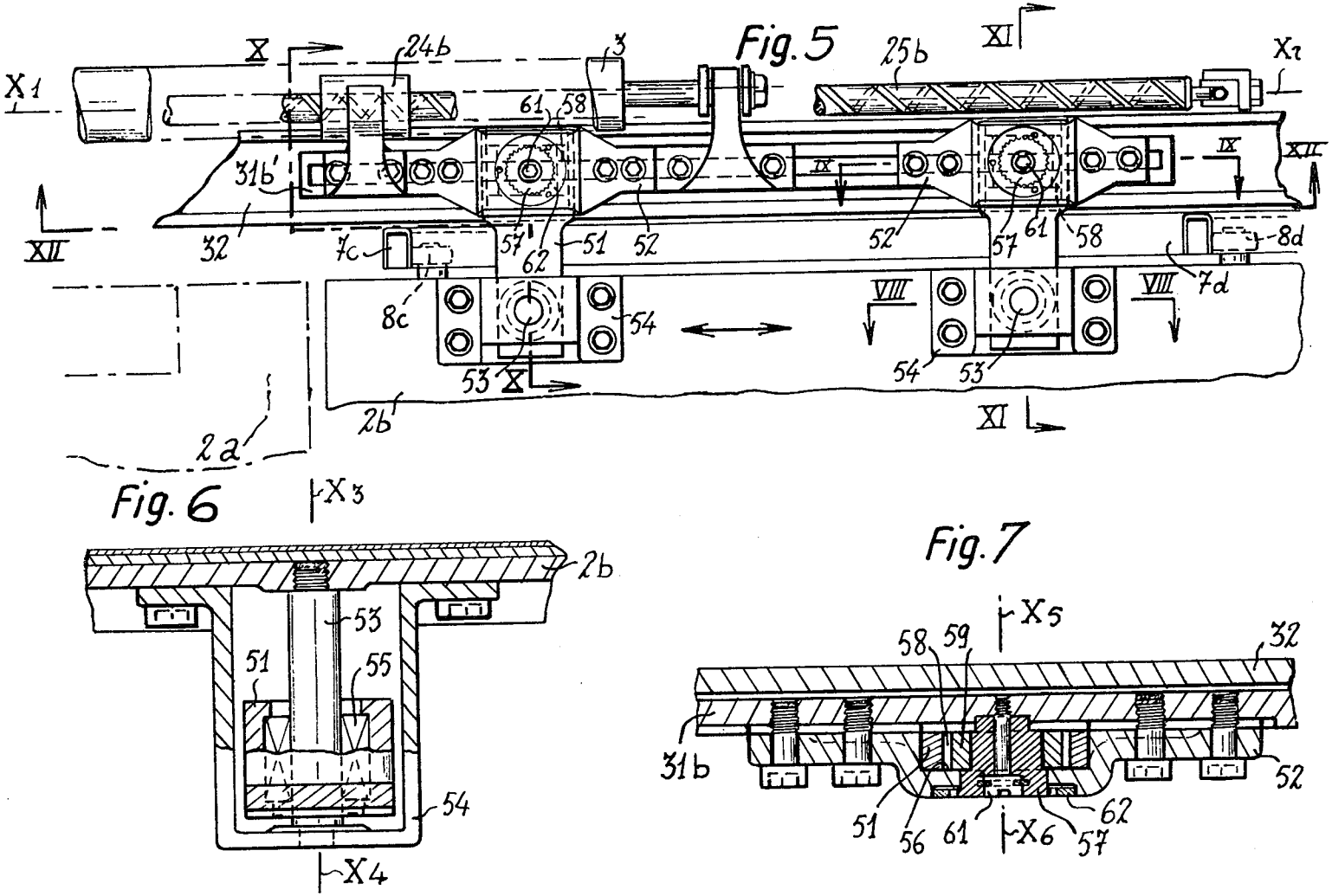
Figure 8:
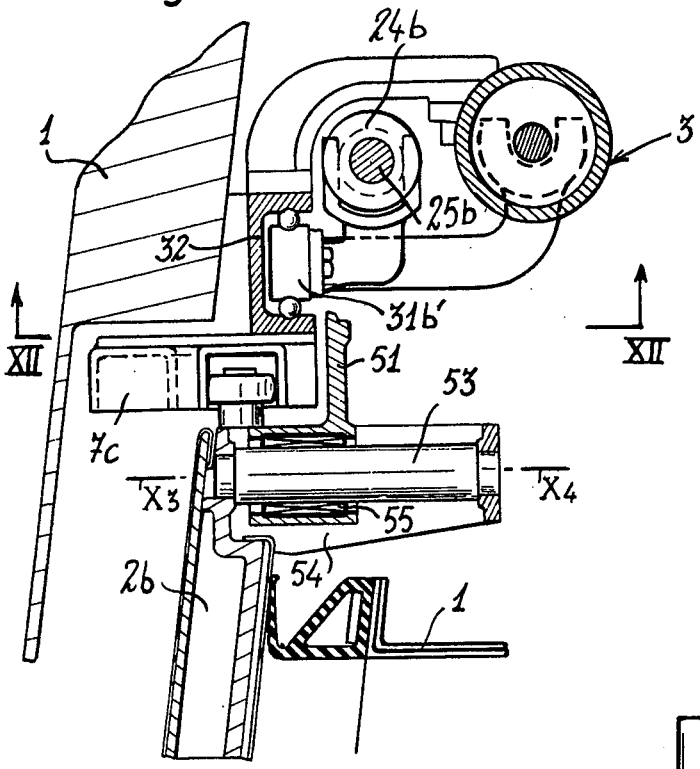
Figure 9:
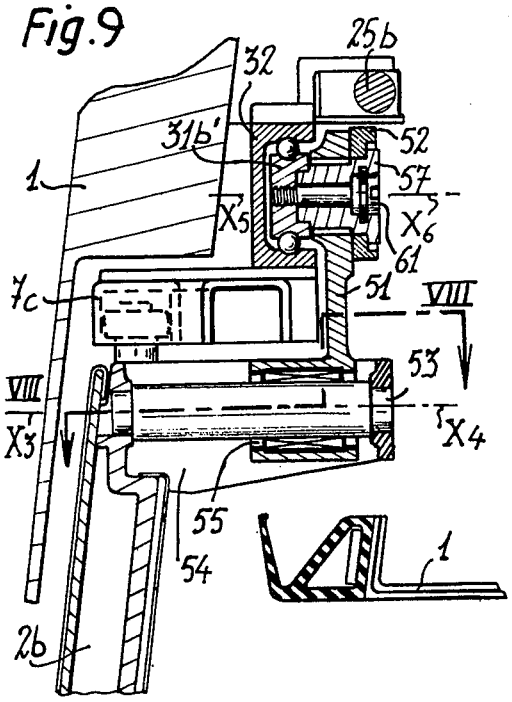
Figure 10:
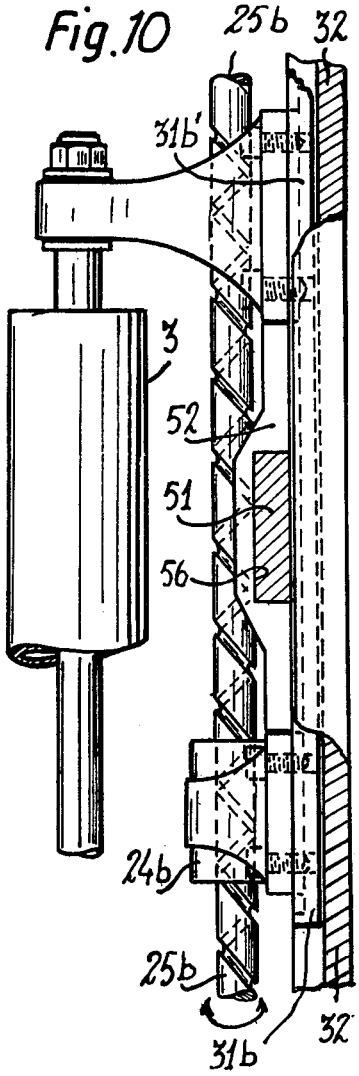

FIG. 4 which is similar to FIG. 3 shows the same door in the open position;

FIG. 5 which is similar to the right-hand portion of FIG. 1 is a front view of a second industrial form of construction of the door in accordance with the invention;

FIGS. 6 and 7 are horizontal part-sectional views of the leaf-suspension system, these views being taken along lines VIII—VIII and IX—IX of FIG. 5;

FIGS. 8 and 9 which are similar to FIGS. 3 and 4 are vertical sectional views taken along lines X—X and XI—XI of FIG. 5;

FIG. 10 is a horizontal sectional view seen from underneath FIG. 5 and taken along line XII—XII.

In a first industrial form of construction which is shown in FIGS. 1 to 4, the oblique-displacement door is a double door consisting of a stationary frame 1 and two flat leaves 2*a*, 2*b* which are mounted symmetrically so as to be capable of sliding with respect to the door-frame 1 along the same axis X1–X2 of sliding motion. The sliding motion of the door-leaves is controlled by operating means which produce action in the direction of the axis X1–X2 and comprise a double-acting compressed-air jack 3 associated with pipes and a control system not shown.

The door-leaves 2*a*, 2*b* can be remotely actuated by the control system in accordance with known practice by supplying the pipes in a suitable manner. The control system also makes it possible by means of an emergency control unit (not shown) to put the pipes into communication with the atmosphere in order to produce manual action on the door-leaves by means of emergency operating handles 6*a*, 6*b*. The opposite movements of the door-leaves 2*a*, 2*b* along the axis XI–X2 of sliding motion are carried out by means of a coordinating mechanism which will be described below.

The door-leaves 2*a*, 2*b* are associated with guiding means for engaging the leaves within the door-frame 1 in the position of closure and disengaging the leaves from the frame in the opposite direction. In the embodiment herein described by way of example, the means for guiding the door-leaves 2*a*, 2*b* comprise rails 7*a*, 7*b* and 7*c*, 7*d* of the U-section type, for example, and located opposite to the top edge of each door-leaf. Said rails are rigidly fixed to the door-frame 1 and each have a rectilineal portion parallel to the axis X1–X2 of sliding motion and an oblique portion connected to the rectilineal portion by a rounded elbow. With each top rail 7 (*a, b, c, d*) is associated a roller 8 (*a, b, c, d*) which is rigidly fixed to a top edge of a door-leaf 2*a*, 2*b*.

Similarly, provision is made opposite to the bottom edge of the door-leaves 2*a*, 2*b* for guide rails 11 (*a, b, c, d*) which are similar to the top rails. Each guide rail is associated with one roller 12 (*a, b, c, d*) which is secured to the bottom edge of one of the door-leaves 2*a*, 2*b*.

Stabilizing means are provided for maintaining an axis of the plane of each door-leaf at right angles to the axis X1–X2 of sliding motion in order to prevent any jamming of the rollers in the guide rails 7 and to ensure very smooth operation.

In accordance with the invention, the means for stabilizing each door-leaf 2*a*, 2*b* comprise at least one slide-bar 31*a*, 31*b*, said carriage being slidably mounted on a slide-way 32 which is rigidly fixed to the door-frame 1 opposite to the top edge of each door-leaf 2*a*, 2*b* in parallel relation to the axis X1–X2 of sliding motion and in proximity to the rails 7*a*, 7*b* and 7*c*, 7*d*. Each slide-bar 31*a*, 31*b* is connected to the top edge of the corresponding door-leaf 2*a*, 2*b* by means of two crank-arms 16*a*, 16*b* and 16*c*, 16*d* which are respectively parallel to each other.

A slide-bar 31*a*, 31*b* is mounted opposite to the top edge alone of each door-leaf 2*a*, 2*b*. Each slide-bar 31*a*, 31*b* which has thus been mounted is located in the proximity of at least one guide rail 7*a*, 7*b* which is rigidly fixed to the door-frame 1 and associated with the aforementioned edge of each door-leaf 2*a*, 2*b*. The slide-bar 31*b* is connected directly to the operating means constituted by the jack 3. The other slide-bar 31*a* is connected indirectly to the same jack as will be explained hereinafter.

One extremity of each crank-arm 16 *(a, b, c, d)* is pivotally mounted on the corresponding door-leaf 2*a*, 2*b* and the other extremity of each crank-arm is pivotally mounted on the associated slide-bar 31*a*, 31*b*. In the case of each crank-arm, the pivotal axes of the extremities Y1, Y3 and Y5, Y7 as well as Z1, Z3 and Z5, Z7 are parallel to the plane of the corresponding door-leaf 2*a*, 2*b* and perpendicular to the axis X1–X2 of sliding motion.

Thus the pivotal axes of the crank-arms are all parallel to each other and define in the case of each door-leaf 2*a*, 2*b* an axis of stabilization which is contained in the plane of the leaf and perpendicular to the axis X1–X2 of sliding motion. For example, it is possible for the assembly and adjustment of the leaf 2*a* to take an axis of stabilization which passes through the axis of the roller 8b and in the case of the leaf 2b to take an axis of stabilization which passes through the axis of the roller 8c.

The length of each carriage 14a, 14b is substantially equal to the dimension of the associated door-leaf 2a, 2b as measured along the axis X1–X2 of sliding motion. Taking into account the necessary mechanical play, this makes it possible to ensure maximum stability of the door-leaves 2a, 2b at right angles to the axis X1–X2 of sliding motion in order to prevent any jamming of the top rollers 8 and of the bottom rollers 12 in the corresponding rails 7 or 11 (as shown in FIGS. 3 and 4).

As shown in FIGS. 3 and 4, it is preferably ensured that the transverse guide rails 7, 11 have a U-shaped profile which ensures appreciable vertical play for each roller 8, 12. As will be explained later, this vertical play of the rollers 8, 12 makes it possible to forestall any danger of oppositely-acting vertical stresses which would be liable to impair the smoothness of operation of each door-leaf 2.

The deformable coupling system of each door-leaf 2a, 2b such as the system which is constituted by the articulated crank-arms 16c, 16d as shown in FIGS. 1 and 2 comprises means for suspending the door-leaf such as the leaf 2b from the associated slide-bar 31b. As will be explained hereinafter, these suspension means are preferably adjustable, thereby making it possible to modify the position of each door-leaf 2 with respect to the associated carriage 31 in the vertical direction.

Each top roller 8 and bottom roller 12 is mounted on a top connecting member 21 or a bottom connecting member 22 which is removably fixed on one of the corresponding edges of a door-leaf 2a, 2b and has a transverse arm which projects with respect to the plane of the door-leaf on the side corresponding to the associated slide-bar 31a, 31b. The top rollers 8 are mounted on the connecting members 21 at the end corresponding to the base of said members and substantially in the plane of each leaf 2a, 2b. On the other hand, the bottom rollers 12 are each mounted on the extremity of the arm of the corresponding connecting member 22 at the end remote from the base of said member which is secured to the bottom edge of the door-leaf 2a, 2b.

The top connecting members 21 (shown in FIG. 1) are each fitted at the end remote from the door-leaf 2a, 2b with a pin on which is mounted a crank-arm 16 for pivotal motion about one of the axes Y3, Y7 and Z1, Z5 which are parallel to the axis of stabilization of the door-leaf. The rod of the operating jack 3 is secured to the slide-bar 31b by means of a cross-member 23b in the vicinity of the pivotal axis Z3 of the crank-arm 16c.

The cross-member 23b carries a nut 24b associated with one of the two portions 25b of a threaded rod having screw-threads of opposite pitch for ensuring coordination of the two slide-bars 31a, 31b. The other portion 25a of the coordinating rod is associated with a nut 24a, said nut being rigidly fixed to a cross-member 23a which is similar to the cross-member 23b and attached to the carriage 14a.

The pitch of the opposite screw-threads of the two portions 25a, 25b of the coordinating rod are chosen so as to ensure that this latter together with its associated nuts 24a, 24b and the cross-members 23a, 23b constitute a reversible-action motion converter between the jack 3 and each door-leaf 2a, 2b as will be explained hereinafter. For example, in the case of a coordinating rod having a diameter of 15 to 20 mm, a grooved screw-thread having a pitch of approximately 80 mm per revolution is adopted. By way of example, the nuts 24a, 24b are of the ball-circulation type which ensure very smooth operation.

In the embodiment described thus far by way of example, the crank-arms 16a, 16b and 16c, 16d of each door-leaf 2a, 2b are parallel and of equal length. In conjunction with the corresponding slide-bars 31a, 31b and with the crank-arms 16, each door-leaf 2a, 2b accordingly constitutes a deformable parallelogram.

The operation of the door which has just been described will now be explained.

Assuming that the door-leaves 2a, 2b are located in the closed position, the operating jack 3 is actuated in the appropriate direction by means of the control system in order to operate the door-leaves. The rod of the jack displaces the cross-member 23b. Said cross-member accordingly drives the slide-bar 31b and causes this latter to slide along an axis which is parallel to the axis X1–X2 of the jack 3. The slide-bar 31b is connected to the leaf 2b by means of the crank-arms 16c and 16d and causes said leaf to move while being guided by the rollers 8c, 8d along the rails 7c, 7d which ensure the desired movement of oblique displacement. At the same time, the obliquity of the crank-arms 16c, 16d varies so as to follow the transverse movement of displacement of the door-leaf 2b.

During the movements of the leaf 2b, the rigidity of the parallel pivot-pins having the axes Z1, Z3 and Z5, Z7 of the crank-arms 16c, 16d ensures stabilization of the leaf 2b while also ensuring that its axis of stabilization which passes for example through the axis of the roller 8c is maintained at right angles to the axis X1–X2 of sliding motion. The stabilization of the leaf 2b which is thus ensured by means of the parallel relation of the pivotal axes of the crank-arms 16c, 16d permits of displacement without jamming of the rollers 8c, 8d within the top rails 7c, 7d and of the bottom rollers 12c, 12d in the corresponding guide rails 11c, 11d.

Each displacement of the nut 24b carried by the cross-member 23b initiates the movement of rotation of the two threaded portions 25a, 25b of the coordinating rod and ensures symmetrical displacement of the nut 24a which is carried by the cross-member 23a. This latter in turn drives the slide-bar 31a and the door-leaf 2a by means of the crank-arms 16a and 16b. As has been seen in the case of the leaf 2b, the movement of oblique displacement of the leaf 2a is guided by the rails 7, 11 which are associated with the rollers 8, 12.

In order to operate the two door-leaves 2a, 2b by hand, the emergency control unit (not shown) of the control system makes it possible to establish a communication between the two pipes of the jack 3 and the surrounding atmosphere. The door-leaves can then be hand-operated directly by means of the handles 6a, 6b since the two threaded portions 25a, 25b of the coordinating rod constitute a reversible-action motion converter between the slide-bars 31a, 31b and the jack 3. Moreover, the movements of the two door-leaves 2a, 2b are always symmetrical by virtue of the coordinating rod consisting of two threaded portion 25a, 25b of opposite pitch.

The slideway 32 is rigidly fixed to the door-frame 1 and to the top guide rails 7; the rectilineal portion of said rails is aligned with the axis X1–X2 of sliding motion and attached to the bottom portion of the slideway 32 (as shown in FIGS. 3 and 4).

On the side corresponding to the door-leaf 2b, the operating rod of the jack 3 is associated with the slide-bar 31*b* and with the nut 24*b* by means of the arcuate cross-member 23*b* (as shown in FIGS. 3, 5, 6) whereas, on the side corresponding to the door-leaf 2*a*, the nut 24*a* is connected to the slide-bar 31*a* by means of the short cross-member 23*a*. This arrangement makes it possible to reduce the overall size of the door mechanisms by superposing substantially in the same vertical plane the rectilineal portion of each top rail 7 which is aligned with the axis X1–X2 of sliding motion, the slideway 32, the threaded coordinating rod 25 and the rack 3 (shown in FIGS. 3 and 4).

The above-mentioned superposed arrangement is facilitated by the arcuate shape of the cross-member 23*b* which connects the operating rod of the jack 3 to the slide-bar 31*b* while passing around the profile of the supports of the coordinating rod 25*a*, 25*b* (as shown in FIGS. 1, 3, 4).

The connecting members 21 which are attached to the top edges of the door-leaves 2*a*, 2*b* each comprise means for suspending the leaves from the associated slide-bars 31*a*, 31*b* by means of the crank-arms 16. The suspension means aforesaid comprise an adjusting device for modifying the position of each leaf 2 with respect to the corresponding slide-bar 31 in the vertical direction.

The axes of pivotal motion of the crank-arms 16 are materialized by parallel pivot-pins shown in the detail view of FIG. 2 with reference to the axes Z5 and Z7 of the crank-arm 16*d*. On the side nearest the connecting member 21*d* of the door-leaf 2*b*, the pivotal axis Z5 of the crank-arm 16*d* is materialized by an internally-threaded bore which is split in a direction parallel to its axis. By means of transverse screws 34, a threaded rod 33 which is engaged within said bore can thus be locked in position.

The bottom head of the threaded rod 33 is provided with a spherical knuckle-bearing 35 mounted in a cup for retaining the free extremity of the connecting member 21*d* which is attached to the door-leaf 2*b*. A square operating nut 36 serves to modify the penetration of the threaded rod 33 within the bore of the crank-arm 16*d* in order to adjust accurately in the vertical direction the position of the door-leaf 2*b* with respect to the ball-slideway 32.

The arm of each connecting member 22 which is attached to the bottom edge of one of the leaves 2*a*, 2*b*, (as shown in FIGS. 3, 4) is engaged beneath a floor element 43 which is rigidly fixed to the door-frame 1 opposite to the bottom edge of the leaf. The bottom guide rollers 21 which are each mounted at the extremity of one of the arms aforesaid are associated with the U-section rails 11 mounted beneath the floor element 43.

The vertical adjusting-rods 33 thus make it possible to adjust with precision the extent of penetration of each top roller 8 and of each bottom roller 12 within the U-section profile of the corresponding rail 7 or 11. The knuckle-bearings 35 of each adjusting-rod 33 provide the necessary flexibility for assembly of the door-leaves 2*a*, 2*b* with respect to the top and bottom rails 7, 11, taking into account any possible flexural deformations of the leaves 2*a*, 2*b* and of the door-frame 1 or certain irregularities in the alignment of the rails 7, 11.

It is apparent that the invention offers a number of important advantages. The absence of toothed racks and stabilizing guides on the door-leaves 2*a*, 2*b* simplifies the construction of these latter while reducing both their weight and their overall size. Similarly, the absence of any coordinating shaft and of pinions associated with the toothed racks makes it possible to ensure that the passageway available within the door-frame 1 is completely clear and unobstructed in the open position of the door-leaves 2*a*, 2*b* (as shown in FIG. 1).

By virtue of the superposed arrangement of the top rails 7, of the slideway 32, of the coordinating rod having two threaded portions 25*a*, 25*b* and of the actuating jack 3, all the mechanisms for control and stabilization of the door-leaves 2*a*, 2*b* can readily be housed within a casing which is close to the top edges of these latter, for example the casing 44 shown in FIGS. 3 and 4. The mechanisms associated with the bottom edges of the door-leaves are limited to the bottom rails 11 and to the rollers 12 which are connected to the leaves by means of the arms of the connecting members 22 entirely outside the doorway provided within the frame 1 in the open position.

The parallel alignment and rigidity of the pivotpins corresponding to the axes Y and Z of the crank-arms 16 at the time of assembly ensures effective stabilization of the door-leaves 2*a*, 2*b* with a small number of components while ensuring maximum clearance for the passageway provided in the door-frame 1 and for the two faces of each door-leaf. Adjustment of the position of each leaf 2*a*, 2*b* with respect to the slideway 32 and with respect to the top rail 7 and bottom rail 11 is easily carried out by means of the threaded rods 33 (FIG. 2) which modifies the length of the system for suspending the two connecting members 21 of each door-leaf from the associated slide-bar 31*a*, 31*b*.

By virtue of the special mode of suspension of the door-leaf in which only the top edge of this latter is connected to the slide-bar 31 of the slideway 32, smooth and silent operation of the door is ensured, especially in the case of emergency operation by hand. In fact, as shown in FIGS. 5 and 6, the transverse guide rollers 8, 12 are associated with the shaped-section rails 7, 11 and preferably U-section rails, thereby endowing the rollers 8, 12 with appreciable vertical play. Since the door-leaf is also maintained in sliding motion along the precise axis of the slideway 32, any potential danger of oppositely-acting vertical stresses which would be liable to result in roughness of operation or even in jamming of the door-leaf is accordingly forestalled. In fact, it is practically impossible to ensure accurate parallel alignment of the guide rails 7, 11 relative to each other and to the slideway 32 by reason of the inevitable deformations of the door-frame 1, said frame being attached to the structure of the vehicle which is subjected to variable loads and forces.

As is readily apparent, the invention is not limited to the embodiment which has just been described by way of example and many alternative forms can be devised without thereby departing from either the scope or the spirit of the invention.

From this it follows that the invention is applicable to doors in which the profile of the leaves is substantially in the form of a circular arc in the direction of horizontal sliding motion or curved in the vertical direction. The invention also applies to doors in which the leaves are displaced in sliding motion along two axes which are slightly inclined with respect to each other.

The door can clearly have only one leaf instead of two or even consist of any number of leaves which are either independent or have coordinated movements. A number of different designs can be contemplated for the mechanisms which serve to coordinate the leaves with respect to each other, such mechanisms being constituted in particular by endless chains or the like which may be associated for example with a reduction-gear motor. The choice of these various alternative designs may be governed in some instances by contingencies of available space in the vicinity of the edges of the door-leaves.

There is shown in FIGS. 5 to 10 a second industrial form of construction of a door which consists of two leaves *2a, 2b* in accordance with the invention and is similar to the door of FIG. 1. In this second embodiment, the deformable coupling system which connects the slide-bar 31*b'* to the top edge of the corresponding leaf *2b* comprises two substantially vertical suspension arms 51. Each arm 51 has an upper extremity which is rigidly connected to the slide-bar 31*b'* by means of a yoke 52 which is screwed onto the slide-bar and a lower extremity which is slidably mounted on a rod 53, said rod being attached to the edge of the door-leaf *2b* (as shown in FIGS. 6 and 8) and located transversely to this latter.

In the embodiment herein described by way of example, the transverse rod 53 is cylindrical and maintained on the door-leaf *2b* by means of a lantern casing 54 which projects from the edge of the leaf and is screwed onto this latter. The lower extremity of the suspension arm 51 which is provided for example with a ball-circulation slideway 55 which is fitted over the rod 53 with a high degree of precision is capable of sliding along said rod and of moving within the lantern casing 54 transversely to the reference plane of the leaf *2b*.

A device for adjusting the position of the leaf *2b* with respect to the slide-bar 31*b'* in the vertical direction is associated with each yoke 52. Said device comprises a vertical guide 56 formed in each yoke 52 for the upper extremity of each suspension arm 51 which is slidably adjusted within the guide 56.

The yoke 12 carries an eccentric 57 having a horizontal axis X5–X6 which passes through a rectangular recess 58 of the upper extremity of the arm 51 which is engaged within the yoke 52. The eccentric 57 is adjusted within a bore of an intermediate cage 59 which has a rectangular cross-section and is capable of sliding in the horizontal direction along two edges of the recess 58 (as shown in FIGS. 5 and 7).

In the service position, the eccentric 57 is securely maintained by the head of an axial screw 61, the extremity of which is engaged within an internally-threaded bore of the slide-bar 31*b'*. Said eccentric is also locked in position by means of an annular member 62 which is fixed in the external face of the yoke 52 and is provided with an internal set of teeth disposed in meshing engagement with a peripheral set of teeth of the head of the eccentric 57. An internal ring carried by the screw 61 serves to place the eccentric 57 in a position in which it projects from the toothed annular member 62. By displacing the eccentric 57 in rotation by means of a special ring-spanner (not shown) adapted to the head of said eccentric, the vertical adjustment of the suspension arm 51 of the door-leaf *2b* which is connected to the slide-bar 31*b'* is modified by means of the intermediate cage 59, the eccentric 57 and the yoke 52 (as shown in FIG. 9).

As has been noted in the foregoing description, the independent adjustment of the vertical position of each of the two suspension arms 51 (FIG. 5) permits accurate positioning of the guide rollers 8*a*, 8*b* of the door-leaf within the sectional guide rails *7c, 7d*. This adjustment also makes it possible to ensure accurate parallel alignment of the opposite edges of the door-leaves *2a, 2b*.

By virtue of the ball slideways 55 shown in FIG. 6, the transverse motion of the door-leaf *2b* on the rods 53 takes place in a very smooth manner, thus facilitating the sliding motion of the door-leaf along the axis X1–X2. The assembly of the upper extremity of each suspension arm 51 for vertical sliding motion within the guide 56 of the corresponding yoke 52 (as shown in FIG. 5) ensures the rigid association of the door-leaf *2b* and the slide-bar 31*b'* in the direction of the axis X1–X2. This accordingly prevents the lateral inclination of the suspension arms 51 under the action of the operating jack 3 and of the inertia of the door-leaf. As a further consequence, any abnormal friction in the leafguiding system is prevented and smooth and silent operation of the door-leaf is ensured over long periods of even intense service.

I claim:

1. An oblique-displacement sliding door comprising a stationary door-frame and at least one door-leaf which is vertical in the service position and capable of moving along a substantially horizontal sliding axis parallel to a top edge and a bottom edge of the door-leaf, said edges of the leaf being associated with fixed guide rails attached to the door-frame, in order to be engaged transversely within the door-frame in the closed position and disengaged from the frame in the opposite direction, operating means for moving the door-leaf along the sliding and stabilizing means for maintaining each leaf parallel to said sliding axis and comprising for each leaf a single slide-bar connected to the operating means and mounted in a slideway parallel to said axis, the slideway being fixed on the door-frame, the top edge of the door-leaf being suspended from the slide-bar by a deformable coupling system for a translational displacement of the leaf driven by the slide-bar along the axis of the guideway and a transverse displacement of the leaf with respect to the slide-bar under the action of the guide rails, two opposite leaves mounted symmetrically on each side of the door, the slide-bars associated respectively with each door-leaf being mounted on slideways having a common axis, and the movements of the slide-bars being combined symmetrically by a coordinating mechanism comprising on each slide-bar a nut combined with a threaded rod rotatably mounted on supports connected to the frame in parallel relation to the axis of the slideways, wherein the rod and the nut associated with each slide-bar on each door-leaf have such a thread as to constitute a reversible-action motion converter between the two door-leaves and a rod of an actuating jack fixed to the door-frame in parallel relation to the axis of the slide-ways, said rod being connected with a slide-bar of a leaf, the slideway which is parallel to the axis of sliding motion of the door-leaves being bove the rails for guiding the top edge of each door-leaf, the threaded rod for the coordination of the door-leaves and the operating jack being substantially in superimposed relation above said rails and slideway, the rod of said jack being connected to one of the slide-bars by means of an arcuate cross-member which passes around the profile of the supports of the coordinating rod.

2. An oblique-displacement sliding door comprising a stationary door-frame and at least one door-leaf which is vertical in the service position and capable of moving along a substantially horizontal sliding axis parallel to a top edge and a bottom edge of the door-leaf, said edges of the leaf being associated with fixed guide rails attached to the door-frame, in order to be engaged transversely within the door-frame in the closed position and disengaged from the frame in the opposite direction, operating means for moving the door-leaf along the sliding and stabilizing means for maintaining each leaf parallel to said sliding axis and comprising for each leaf a single slide-bar connected to the operating means and mounted in a slideway parallel to said axis, the slideway being fixed on the door-frame, the top edge of the door-leaf being suspended from the slide-bar by a deformable coupling system for a translational displacement of the leaf driven by the slide-bar along the axis of the guideway and a transverse displacement of the leaf with respect to the slide-bar under the action of the guide rails, the deformable coupling system for connecting the slide-bar to the top edge of the door-leaf comprising two substantially vertical suspension arms each having an upper extremity which is rigidly attached to the slide-bar and a lower extremity which is slidably mounted on a horizontal rod which is transverse to the plane of the door-leaf and which is secured to the top edge of the door-leaf.

3. A door according to claim 2, wherein means are provided for vertically adjusting the position of the doorleaf with respect to the slide-bar and comprising on the slide-bar two yokes, each having a vertical guide for the upper extremity of each suspension arm.

4. A door according to claim 3, wherein each yoke carries an eccentric having a horizontal axis which passes through a rectangular recess of the upper extremity of the associated suspension arm, said eccentric being adjusted within a bore of an intermediate cage having a rectangular cross-section which is capable of sliding within the rectangular recess along two horizontal edges of said recess.

* * * * *